US009658026B1

(12) United States Patent
Grace et al.

(10) Patent No.: US 9,658,026 B1
(45) Date of Patent: May 23, 2017

(54) EXPLOSIVE DEVICE UTILIZING FLUX COMPRESSION GENERATOR

(71) Applicants: Fred Irvin Grace, York, PA (US); Eric N. Enig, Bethesda, MD (US); Yil Bong Kim, Silver Spring, MD (US)

(72) Inventors: Fred Irvin Grace, York, PA (US); Eric N. Enig, Bethesda, MD (US); Yil Bong Kim, Silver Spring, MD (US)

(73) Assignee: ENIG ASSOCIATES, INC., Bethesda, MD (US)

( * ) Notice: Subject to any disclaimer, the term of this patent is extended or adjusted under 35 U.S.C. 154(b) by 851 days.

(21) Appl. No.: 13/949,849

(22) Filed: Jul. 24, 2013

Related U.S. Application Data

(60) Provisional application No. 61/675,062, filed on Jul. 24, 2012.

(51) Int. Cl.
*F41H 1/00* (2006.01)
*F41B 6/00* (2006.01)

(52) U.S. Cl.
CPC ..... *F41B 6/006* (2013.01)

(58) Field of Classification Search
CPC ..... F41B 6/006
USPC ..... 89/8
See application file for complete search history.

(56) References Cited

U.S. PATENT DOCUMENTS 5,505,134 A * 4/1996 Brooks ..... E21B 43/1185 102/202.7
7,849,919 B2 * 12/2010 Wood ..... H05H 1/52 102/327
8,387,534 B1 * 3/2013 Imholt ..... F42B 1/00 102/200

* cited by examiner

*Primary Examiner* — Samir Abdosh
(74) *Attorney, Agent, or Firm* — Browdy and Neimark, PLLC

(57) ABSTRACT

An explosive device composed of: a flux compression generator operative to produce a high intensity electric current when activated; and an electrical payload connected to the generator and constructed to receive the high intensity electric current and cause energy in the current to generate a shaped projectile in the payload and to launch the projectile.

9 Claims, 6 Drawing Sheets

EXPLOSIVE DEVICE UTILIZING FLUX COMPRESSION GENERATOR

BACKGROUND OF THE INVENTION

The present invention relates to projectiles containing a flux compression generator (FCG) for producing a high current that acts to produce a metal mass in a manner to project that mass as a jet to penetrate a target.

Flux compression generators are already known in the art. An example thereof is disclosed in U.S. Pat. No. 4,370,576, Foster, Jr., issued on Jan. 25, 1983, and the entirety of which is incorporated herein by reference.

It is known that extremely high magnetic fields can be obtained using high explosives as an energy source in devices known as flux compression generators. In such a generator, an explosive detonation compresses an established low-level magnetic field into a very high density field, with an associated high electrical current flow. Typically, a low-level magnetic field is established within a confined space or cavity and acted upon by the force of explosive detonation to collapse that space to a relatively small volume in which the magnetic field is trapped and compressed. Since the trapped magnetic field exerts magnetic pressure, the explosive does work against that pressure and in the process transfers its chemical energy into electrical energy within the FCG electrical circuit to include the energy stored within the compressed magnetic field. The FCG principles apply to various geometries where the size of the space, or cavity, is reduced. To date, mostly cylindrical geometries have been explored.

There are two types of cylindrical FCGs, namely, coaxial and helical.

A coaxial generator consists of a central cavity containing a centrally located high explosive filled cylindrical shell acting as a conducting armature, a cavity between the armature and an outer metallic shell that acts as a conducting stator, and conducting end caps to complete the electrical circuit and provide confinement of the compressed magnetic field. One example of a coaxial generator that can be employed in devices according to the invention is disclosed in: J. H. Goforth, et al, "The Ranchero Explosive Pulsed Power System," 11$^{th}$ IEEE International Pulsed Power Conference, Hyatt Regency, Baltimore Md., Jun. 29-Jul. 2, 1997.

A helical generator consists of a similar armature, a stator formed from windings of wires, a cavity between the armature and stator, and end caps. Generally, an electrical load, in the form of a relatively small cavity encased in conducting metals, is attached to the output end of the FCG. One example of a helical generator that can be employed in devices according to the invention is disclosed in: A. Neuber, A. Young, M. Elsayed, J. Dickens, M. Giesselmann, M. Kristiansen, "Compact High Power Microwave Generation," *Proceedings of the Army Science Conjfrence* (26th), Orlando, Fla., 1-4 Dec. 2008.

In addition, an internal arrangement within the device is structured so that an electrical "seed" current can be fed to the metal wire conductors forming the circuit of the stator, armature, end caps, and electrical load that define the cavities of the FCG and the load. The flow of current in the conductors around these cavities establishes a "seed" magnetic field within the cavities. The cavities represent inductances while the conductors have electrical resistance. In operation, upon detonation, the armature expands radially and collides with the stator. During that process, flux compression takes place because the FCG cavity width is reduced to nearly zero. To first order, the FCG output current results from the starting inductances of both cavities relative to the final inductance of the system after magnetic compression. When the FCG is completely collapsed, current gain is the ratio of the initial cavity inductance to the final inductance represented by the load.

An advantage of the helical generator with its wire wound stator is that a much higher initial inductance can be obtained per unit length, but at the expense of added complexity. In contrast, the coaxial generator has a simpler construction, but with a considerably lower initial inductance. Both generators can have electrical breakdown (arcing) since the current and voltages rise during compression unless care is taken to use insulating gas in the cavities. The helical generator can also break down if the voltage between wires rises above a threshold limit related to the insulation used between windings. Further, because of Joule heating due to resistance, the wires can only carry a limited amount of current without reaching their melting temperature. For well-designed generators of similar length, typical current gains are 10 to 12 for the coaxial types, and above 2000 for a helical wound generator. Often, coaxial generators are used with much higher seed current to get high output current since premature electrical breakdown and wire melting are not issues.

When initiation of the high explosive (HE) is started at one end of the HE column, i.e. along the length of the generator, the detonation wave travels from that end to the opposite end of the column, referred to as the output end. Armature radial motion first occurs at the initiation end with a progressive expansion from the initiation end to the output end. This sequential motion results in an armature expansion that has a conical profile with the cone becoming progressively larger until successive elements strike the stator. Thus, the armature first strikes the stator at the initiation end and subsequently strikes the stator at progressive locations until impact with the entire stator is complete at the output end. As the armature progressively fills the cavity, magnetic compression progressively takes place. The progression gives rise to a near exponential increase in current to a peak value that occurs near to total cavity collapse where the system inductance has a minimum value. Thus, for the helical generator, initial winding sections are subject to relatively low voltages and temperatures while sections toward the output end approach or exceed the voltage and temperature limits. Internal voltages, electrical breakdown, and wire melting have limited the ability to develop more efficient flux compression generators. In addition, explosive initiation techniques and quality control of fabricated parts including the end caps, stators, and armatures have a major influence on the ability to improve current outputs of FCGs.

Work with explosively driven flux compression in the United States dates back to C. M. Fowler's work published in 1960: C. M. Fowler, W. B. Garn, and R. S. Caird, "Production of Very High Magnetic Fields by Implosion," *Journal of Applied Physics,* 31(3), 1960, pp. 588-594.

Since then, both coaxial and helical generators have been designed, built, and tested. The most notable groups examining helically wound generators include Los Alamos National Laboratory in Los Alamos, N. Mex., as disclosed in: C. M. Fowler and L. L. Altgilbers, "Magnetic Flux Compression Generators: a Tutorial and Survey," *Journal of Electromagnetic Phenomenon,* 3(11), 2003, pp. 305-357, the Kurchatov Institute of Atomic Energy in Moscow, S. Kassel, "Pulsed-Power Research and Development in the USSR," R-2212-ARPA, May 1978, and Texas Tech University in Lubbock, Tex., A. Neuber, et al, supra.

Notable patents pertaining to explosively driven flux compression devices with helically wound generators include U.S. Pat. No. 4,370,576, J. S. Foster and J. R Wilson, U.S. Pat. No. 3,356,869, J. L. Hilton and M. J. Morley, and U.S. Pat. No. 5,059,839M. F. Rose et. al, all of which are incorporated herein by reference.

U.S. Pat. No. 4,370,576 details the operation of helically wound flux compression generators. J. L. Hilton's patent claims the use of complex winding patterns to enhance electrical efficiency for flux compression devices. M. F. Rose patent outlines a flux compression/transformer system for use with high impedance loads.

The cited developments, while exploratory in nature, have not resulted in efficient FCG designs. Mainly, the threshold limits have been low while some FCG's have been relatively large and heavy with low current gains. Further, applications to weaponry have not been forthcoming because of FCG low-output, large size, awkward packaging into warhead compartments within projectiles or missiles, and requirement for external power sources to produce seed current. In addition, for weaponry that deliver lethal kinetic energy, use of FCG's with dynamic loads to produce kinetic energy penetrators and multiple kinetic energy effects has not been investigated.

BRIEF SUMMARY OF THE INVENTION

There exists a demand for multiple effects devices able to penetrate complicated structures, often with behind-the-structure effects requirements. Such devices can utilize integration of the FCG, liners, power supply, and follow-through devices into a compact, autonomous package. Prior FCG state-of-art technology does not lend itself to weapons for multimodal roles.

Conventional shaped charges and Explosively Formed Penetrators (EFP) also cannot always meet requirements for multiple roles. Typically, tandem warheads are designed with a large space between two shaped charges, each having its own explosive charge. The design necessitates a blast shield with space to protect the rear charge from the forward charge—a configuration demanding a long length. When a follow-through munition is utilized, the tandem and follow-through devices are placed in series, which demands very large lengths and high weights. Often, length and weight constraints of the carrier system (projectiles or missiles) preclude the use of conventional approaches. Further, a full diameter follow-through munition is often too heavy and can only be used at a substantial sub-caliber size. In that case, the space around that component is wasted. In addition, two detonators must be used to fire the tandem warhead, so additional complexities with fusing arise. A conventional shaped charge has a fixed energy output and therefore does not lend itself to a conditional response where collateral damage is of concern or where selectable yield performance is desired.

The present invention overcomes many of the drawbacks. The FCG acts as a global source of energy that can be focused to power multiple liners to include dual liners where electrical energy is applied through electrical conduits connecting the FCG with the electrical loads. Timing for the action of each liner can be accomplished through dynamic electrical switching. When a follow-through munition is employed, the FCG can be designed as an annular coaxial structure that encloses the munition at its center. Since no explosives surround liner loads, and the munition resides within the FCG, a highly compact and efficient multiple mode warhead can be constructed. A single detonator activates the FCG, which in turn powers the liners without further HE initiation. The present invention constitutes a higher efficiency FCG than previous designs by combining in "unitary" fashion an initial helical section where currents are relatively low with a final coaxial section where current is high. Also, the present invention utilizes several helical winding sections along its length, each with varied pitch and wire size to accommodate increased currents as the armature engages successive stator sections. At the ends of each helical winding section, wires are bifurcated to allow each section to progressively cope with increasing current by splitting that current between multiple wires. This approach provides a highly efficient FCG design with increased output current to project higher levels of lethal kinetic energy.

The output of the FCG can be connected to selected loads through thin insulated channels. Upon command, the selected load is connected to the FCG by dynamic switching. Using a FCG power source, sufficient thermal energy is available through Joule heating to ignite RMs at multiple and closely spaced sites to obtain rapid and abrupt near volume combustion.

Any and all of the aforementioned techniques can be combined into a single warhead configuration to produce multi-modal kinetic energy/blast effects. The technology is scalable and thus can be applied to various systems to include small hand placed devices to large missiles and projectiles. In total, therefore, the invention has advantages in terms of utility, costs, and performance over prior art or conventional approaches.

The present invention provides a projectile or missile that includes the following components: 1) a central munition; 2) a wrap-around FCG, i.e., an FCG composed of annular components that enclose the central munition: 3) dual liners as the electrical load; 4) a buffering system; 5) a generator explosive; 6) an initiation scheme to ring initiate the FCG explosive, and 7) an electronics package for producing a seed current for the FCG. The dual liner includes: a shaped charge; a shaped charge end cap; a shaped charge stator; a circular switch; an MFP stator; and an MFP.

The present invention provides a flux compression generator that is unified in that it utilizes components of helical and coaxial stator structures to provide additional energy to act on targets.

The present invention allows a compact, multiple kinetic energy, and/or high explosive, and/or blast effects to act on a target.

The present invention provides greater efficiency in converting explosive energy into mechanical energy associated with projection of kinetic energy projectiles.

The present invention provides means for selecting kinetic energy forms and directions to act on a target.

DETAILED DESCRIPTION OF THE INVENTION

Figure 1:
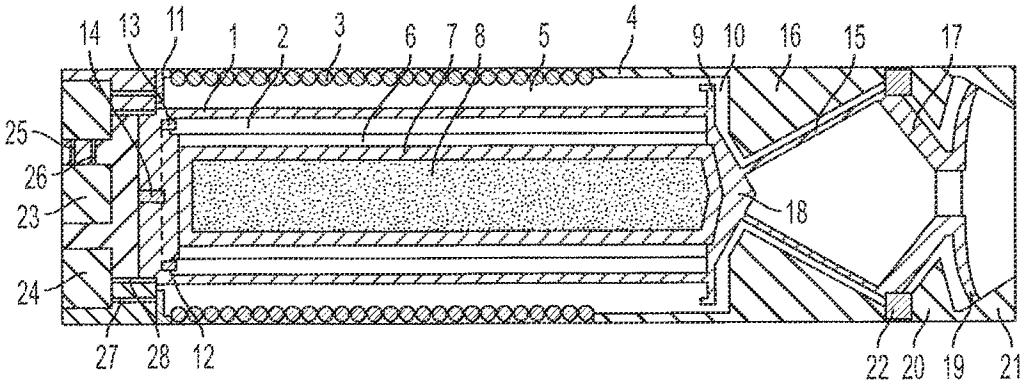
FIG. 1 is a cross-sectional view of one embodiment of the invention, which will be housed in a suitable projectile, or missile.
Figure 3:
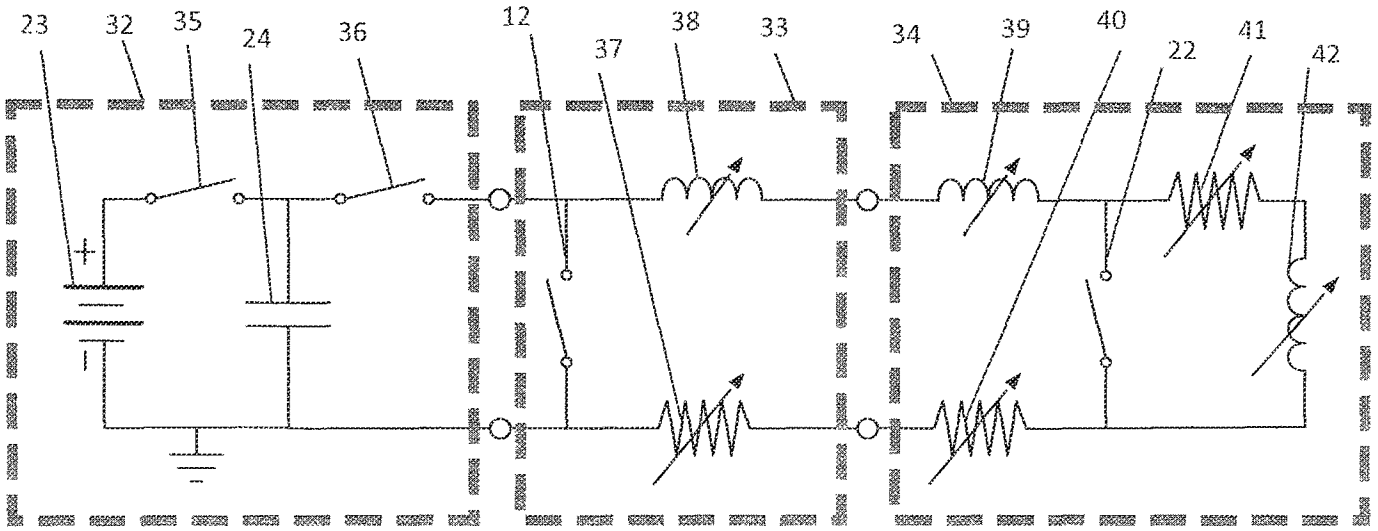
FIG. 3 is a diagram of an electrical circuit according to the invention, which will be housed in a suitable projectile or missile.

The basic components of an explosive device for launching kinetic energy according to the invention are shown in FIGS. 1 and 3. The device includes a flux compression generator, electrical loads composed of two shaped charge liners, a central munition, a means to detonate the high explosives, and an electronic unit to produce starting current for the generator.

As shown, the FCG portion of the system has an armature 1, an annular shell of high explosives (HE) 2 enclosed by armature 1, a helical wound stator 3 surrounding armature 1, a stator 4 aligned with, and electrically connected to, stator 3, and a cavity 5. A buffer 6 separates high explosives 2 from the centrally located munition having a metallic casing 7 that is filled with explosive 8 having its own detonator 8*a*. The generator output end, to the right in FIG. 1, contains an armature glide rail 9 and an insulated channel 10. The initiation end that is opposite to the output end utilizes glide rail 11 together with a gap 12 that will act as a switch, known as a crowbar switch. Ignition of the high explosives 2 is initiated by a "ring" circular initiator 13 that is in turn ignited by ignition of a detonator 14.

Attached to the FCG output end is an electrical load that in this case contains a dual liner arrangement 15, 19.

A shaped charge liner 15 is a conical shell disposed coaxially with respect to a longitudinal axis of the device, enclosed by a liner stator 16 with a so-called "glide" plane, or glide surface, 17 in conductive contact with the large diameter end, or base, of liner 15, and with a glide plane 18 making conductive contact with the small diameter end, or apex, of liner 15. The glide planes guide the armature ends along their respective surfaces to maintain contact which to keep the circuit intact as the armature moves outward. Liner 15 can have various cross-sectional shapes, such as conic sections, tulip, trumpet, or be freely varied depending on the formed penetrator structure desired.

Positioned beyond the liner base end is the MFP section of the dual liner load. MFP liner 19 is coaxial with, and may or may not have the same diameter as, an MFP stator 20 and MFP base glide plane 21. Glide plane 17 also serves as the apex glide plane for the MFP liner 19. MFP liner 19 and glide plane 17 enclose a circular hole, or opening, that is concentric to the device central axis. The end of the MFP base glide plane 21 encloses a relatively large diameter hole, or opening, that communicates with exterior space outside the device. Insulated channel 10 extends beyond glide rail 9 and continues between liner 15 and liner stator 16, between base liner glide plane 17 and MFP stator 20, and between MFP stator 20 and MFP liner 19. A circular switch 22 placed along insulated channel 10 at a position between shaped charge section 15 and the MFP section 19 controls the amount of FCG output current being applied to MFP liner 19 relative to that applied to liner 15. MFP liner 19 may have various cross-sectional shapes, such as described above with respect to liner 15.

All of the illustrated components have a circular and annular form and are coaxial with a longitudinal axis of the device.

Figure 4:
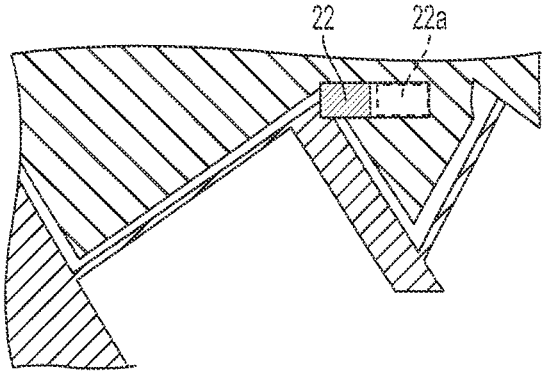
FIG. 4 is a cross-sectional detail view of a portion of the embodiment of FIG. 1.

As shown in FIG. 4, circular switch 22 is an annular, electrically conductive component that is movable into a cavity 22*a*. Initially, switch 22 forms a conductive path between stator 16 and liner 15. After suitable delay switch 22 is pushed into cavity 22*a* by magnetic forces in channel 10 between stator 16 and liner 15.

Exemplary materials for the above described components may include conducting metals such as copper or aluminum for armature 1, wires for stator 3, coaxial section 4, liner stator 16, glide surface 17, apex glide surface 18, MFP stator 20, and MFP glide surface 21. Liner 15 and MFP liner 19 are composed of aluminum, copper, molybdenum, tantalum, for example. Typically, munition casing 7 is made of steel while munition HE 8 is composed of TNT, PBX, TATB, or TATB derivatives. Buffer 6 is a layer of polyethylene or low density shock-absorbing material.

An electronic section 32 is joined to the FCG at the initiation end and contains a battery 23, capacitor 24, a positive electrical connection 25 with a series switch 35 and a negative electrical connection 26 to supply current from battery 23 to capacitor 24. Battery 23 may be a thermal battery, in which case series switch 35 can be omitted. In operation, series switch 35 will be closed or the thermal battery will be activated in response to activation of a point contact fuse or a proximity fuse associated with the device. The electrical circuit from capacitor 24 uses a switch 36 to connect to the FCG. The closing of switch 36 is controlled by suitable electronic circuitry that responds to the charging of capacitor 24 and closes switch 36 when the voltage across capacitor 24 reaches a selected level. When the switch 36 is "on", or closed, capacitor 24 is connected to the helical stator 3 with stator wire 27 and to armature 1 through armature wire 28. An exterior electrical signal activates battery 23 that in turn charges capacitor 24. Circuit switch 36 to the FCG is turned on after capacitor 24 has been fully charged.

In FCG operation, closure of a switch in a standard point contact or proximity fuse on the projectile or missile activates thermal battery 23 and closes switch 35 to in turn charge capacitor 24 in sub-milliseconds. At the end of the charging period, circuit 36 switch connects capacitor 24 with helical stator 3 through wire 27 and armature 1 through wire 28. Flow of current out of capacitor 24 passes, in sequence, through the conducting metals of helical stator 3, coaxial stator 4, liner stator 16, switch 22, MFP stator 20, MFP base glide plane 21, MFP liner 19, liner base glide plane 17, liner 15, liner apex glide plane 18, armature 1, and returns to capacitor 24 through wire 28. Thus current flows around cavity 5 and insulated channel 10 throughout the FCG/load system. The current flow establishes a "seed" current in the conductors and a seed magnetic field within cavity 5 and insulated channel 10.

After the seed current and magnetic field are established, detonator 14 is activated. This activation is produced by conventional circuitry in electronic section 32 at a selected after closure of switch 36 and establishment of the seed current. Detonator 14 ignites, or detonates, circular initiator 13, which, in turn, effects an annular detonation of FCG high explosives 2. The annular initiation of explosives 2 creates a detonation wave that travels from the initiation end, adjacent initiator 13, to the output end, adjacent stator 16 and glide plane 18, of the FCG. Pressure resulting from the detonation of explosives 2 accelerates armature 1 at the initiation end firstly to a given outward radial velocity that depends on the masses of armature 1 and high explosives 2, and the specific energy of the type of FCG explosives 2 used. After the initial movement by armature 1 at the initiation end, armature 1 closes gap 12, and strikes glide rail 11. This action shorts out the capacitor 24 from the main FCG circuit that is now comprised of the metallic conductors described previously, but excludes capacitor 24 and thermal battery 23. As the detonation wave sweeps across explosives 2 from initiation end to FCG output end, armature 1 takes on a conical shape and enters cavity 5. Thus, armature 1 engages stator 3 first at the initiation end and progressively contacts additional windings of stator 3 sequentially. Windings of stator 3, after contact by armature 1, are eliminated from the active FCG electrical circuit. The volume of cavity 5 is reduced as armature 1, during its continued, axial progressive outward motion, continues to contact helical stator 3 and subsequently coaxial stator 4 until armature 1 reaches the opening between output end glide rail 9 and coaxial stator 4 delimited, or defined, by insulated channel 10. At that point, the volume, and therefore the inductance, of cavity 5 have been reduced to near zero and FCG function is complete.

In operation, the trapped magnetic field intensity and magnetic pressure acting against inside surfaces of the metallic conductors grow exponentially as armature 1 invades cavity 5. Thus, motion of armature 1 causes a progressively stronger magnetic pressure to act against armature 1. In this manner, displacement of armature 1, driven by the detonation of explosives 2, constitutes work done by explosives 2 in creating a greater magnetic field intensity and electrical current in the circuit. Essentially, chemical energy released by explosives 3 during detonation is converted to electrical energy in the form of a high current and magnetic field intensity.

At the end of FCG function, within the electrical loads consisting of liner 15 and MFP liner 19, an intense magnetic field having field lines in the circumferential direction exists everywhere within channel 10 together with an intense current flow traveling axially along conducting surfaces. Thus, Lorentz forces described by JXB (where J is the current vector, B is the magnetic field vector, and X is the vector cross product operator) are developed in the conductors that cover channel 10. The forces can be seen as a magnetic pressure that accelerates metallic conductors in a direction normal to their surfaces. Generally, liner stator 16 and MFP stator 20 are massive compared to liner 15 and MFP liner 19 so that little kinetic energy is acquired by liner stator 16 and MFP stator 20 during acceleration of liner 15 and MFP liner 19. Liner 15 is imploded by action of magnetic pressure and coalesces violently on the longitudinal axis of the device to form a jet according to jet formation principles. MFP liner 19 can be accelerated forward to form a "washer-like" ring or compact rod on axis depending on its starting inclination. Since liner 15 is inclined at a large angle, it arrives on axis first and forms a jet that travels unobstructed through the hole in MFP liner 19 and liner base glide plan 17. Subsequently, MFP liner 19 forms a compact rod on axis after the entire jet has passed beyond the collapsing MFP liner 19.

To assure that liner 15 is sufficiently accelerated prior to MFP liner 19, switch 22 temporarily prevents current flow about the portion of channel 10 that extends between MFP liner 19 and stator 20. Switch 22 has a small mass and is initially closed but acts as an opening switch in response to magnetic pressure.

Figure 2:
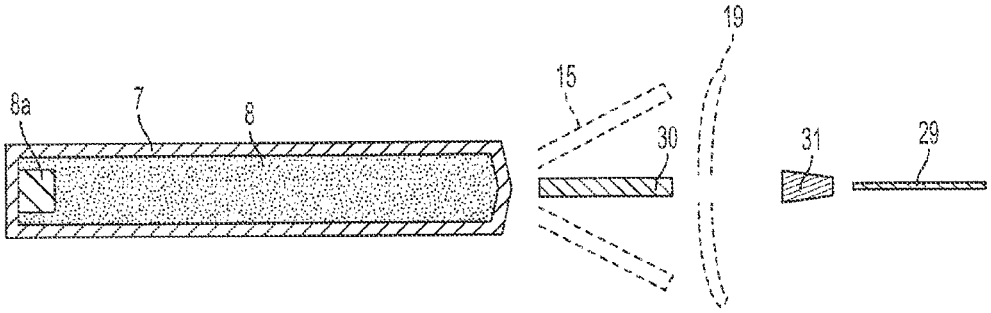
FIG. 2 is a cross-sectional view of the embodiment of the invention as illustrated in FIG. 1, which illustrates FCG action and resulting formed MFP and jet.

FIG. 2 illustrates a point in time after explosives 2 have detonated and the shaped projectiles 29, 30 and 31 have been formed. The previous positions of lines 15 and 19 are shown in broken lines. At this time, detonation of high explosives 2 is complete while the central munition composed of munition casing 7 and HE 8 remain intact due to the provision of buffer 6. Meanwhile, the FCG has delivered kinetic energy to armature 1, and armature 1 has expanded and invaded cavity 5, reducing the volume, and therefore the inductance, of cavity 5 to a minimum. Liner 15 is accelerated, has coalesced at the longitudinal axis of the device, formed jet 29, and passed through the central hole within MFP liner 19. During this jet formation process, liner 15 separates into fast moving jet 29 and slowly moving slug 30. MFP liner 19 also is accelerated to form a rod-like penetrator 31 on the device longitudinal axis. The jet penetrator 29 travels, for example, at a speed of the order of 10 km/s, whereas MFP rod 31 may have a velocity of roughly 2 to 3 km/s and slug 30 may have velocity of 1 km/s. Thus, MFP rod 31 travels faster than slug 30 but slower than jet 29, placing MFP rod 31 between jet 29 and slug 30. Jet 29 and MFP rod 31 act together to impact a target. With proper relative thicknesses and inclinations of liner 15 and MFP liner 19, switch 22 may not be required to obtain an axial arrangement of jet 29, followed by MFP rod 31, followed by slug 30, as previously described.

HE 8 will be detonated upon impact of the device on a target, by activation of detonator 8*a* by a suitable, conventional impact responsive device.

The FCG and electrical loads can be separated by a horizontal extension of channel 10 and surrounding cylindrical shell conductors, allowing space between the two components to accommodate a payload or munition. The FCG electrical energy may be transmitted through an electrical transmission cable so that the load and FCG can be fired remotely and far away from the vicinity of the electrical load.

FCG function as described applies equally well to generators that do not contain a central munition, and do not constitute a "wrapped-around" configuration, but have a solid cylindrical explosive core within the armature. FCG output energy or current depends upon changes in inductances of the FCG and loads, and the level of seed current used to start FCG operation. Thus, FCG devices allow for varied electrical output ranging from the maximum based on FCG design to zero when zero seed current is applied. Control of FCG output energy provides a benefit in application to devices that can be conditionally altered for maximum effects or limited effects to address situations where non-lethal or limited collateral damage are required.

FIG. 3 shows an example of the FCG/load electrical circuit, which includes an electronic section 32, an FCG section 33, and electrical load section 34. Electronic section 32 contains thermal battery 23, capacitor 24, capacitor charging switch 35, and capacitor discharge switch 36. Components in electronic section 32 are connected to FCG variable resistor 37 representing the metallic conductor resistance within the FCG, variable resistor 40 representing the metallic conductor resistance associated with the electrical load section that contains liner 19, variable inductor 38 representing the inductance of cavity 5, and variable inductor 39 representing the inductance associated with the cavity between liner 15 and its stator 16.

Crowbar switch 12 is open initially as current is established in the circuit. Output of the FCG is connected to shaped charge liner 15, represented electrically by a variable inductor 39 and a liner variable resistor 40. Initially, circular switch 22 blocks current to MFP liner 19, represented electrically by a variable resistor 41 and an MFP liner variable inductor 42.

The resistances are associated with the flow of current through metallic conductors and are usually kept small using metals like copper or aluminum, for example. Minimum system resistance allows more efficient energy output from the FCG.

After the entire circuit is activated by discharge of capacitor 24 with closure of switch 36 to establish seed current and seed magnetic field, a firing signal is sent to detonator 14. Consequently, initial motion of the armature closes switch 12, which cuts the circuit in electronic section 32 out of the FCG and load circuit. As the inductance of FCG variable inductor 38 decreases with further armature motion, current increases in the circuit. The increase in current accelerates shaped charge liner 15, thereby creating a progressively increasing cavity between liner 15 and stator 16 and therefore the inductance of liner load inductor 39 increases. The FCG output current reaches a very high level when FCG cavity collapse is complete, but while a high level of liner acceleration results from the high current, time is required to develop appreciable liner displacement and associated increase in inductance of liner inductor 39. Thus, the system inductance of combined liner inductor 39 and FCG inductor 38 reaches a minimum near the time of maximum current. By design, current is supplied first to shaped charge liner variable inductor 39 so that the jet can be formed without interference by MFP formation. Subsequently, circular switch 22 opens to allow current flow through resistors and inductors of both loads.

The seed current and starting values of inductance are related to the peak output current through the generator equation $$I_{peak}=I_{seed}[(L_{FCG}+L_{load})/L_{load}]^{\alpha},$$

where $L_{FCG}$ is the starting generator inductance of inductor 38, $L_{load}$ is the load inductance of inductors 39 and 42 when the FCG inductance of inductor 38 reaches zero, $I_{seed}$ is the starting current flowing through the system, $I_{peak}$ is the peak current generated, and $\alpha$ is a factor that includes resistance losses (heat) and other efficiencies associated with the design. Generally, a is determined empirically to have values in the range 0.70 to 0.8. The equation indicates that current gain can be largely a function of inductance. However, although circuit resistances are kept relatively small for accelerating metal loads, by design resistance can be deliberately high to create Joule heating for other applications.

Figure 5:
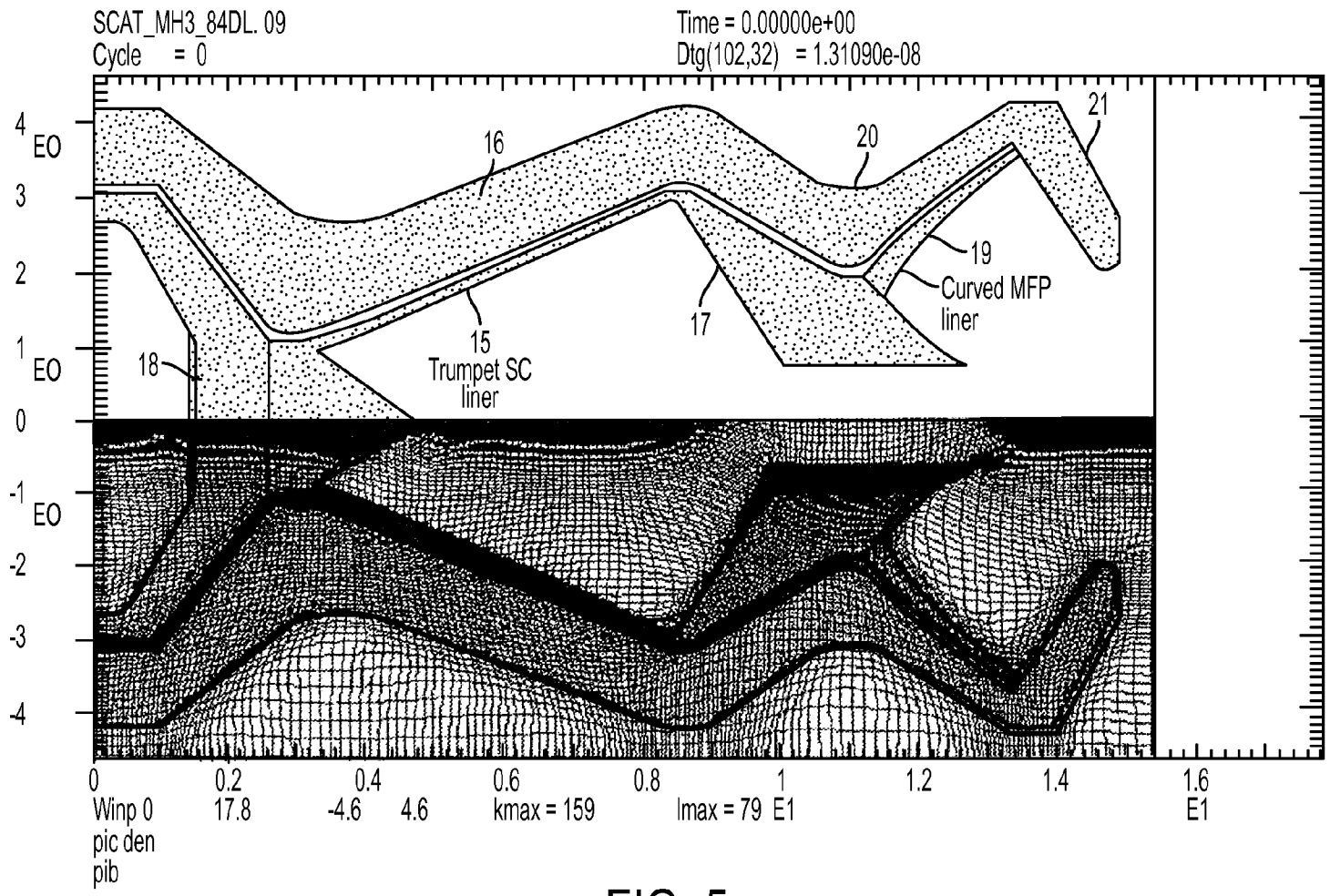
FIG. 5 is a cross-sectional detail view showing one possible specific form of a portion of the embodiment of FIG. 1.

FIG. 5 is a cross-sectional view of one possible practical form of the dual liner. There is shown an insulating layer, or insulating gap, between exterior parts 16 and 20, on the one hand, and interior parts 15, 17 and 19, on the other hand.

Figure 6:
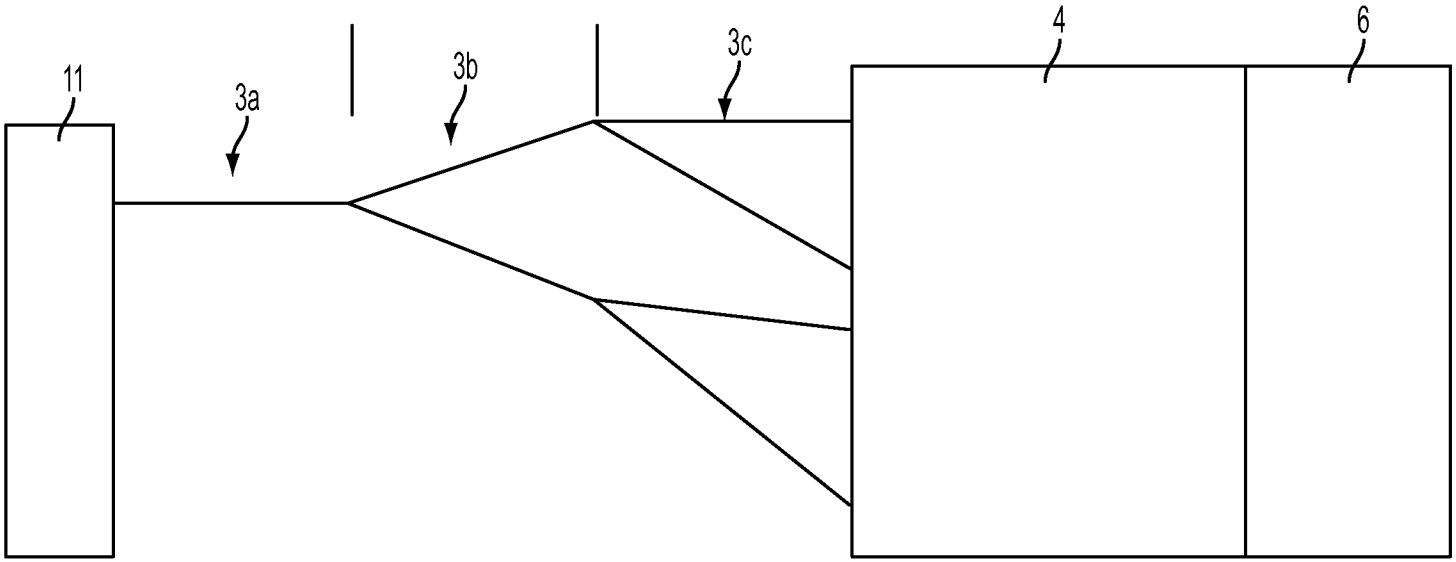
FIG. 6 is a pictorial viewing showing one form of construction of components according to the present invention.

FIG. 6 shows, in an unwrapped or developed form, one preferred embodiment of the stator assembly 3, 4. Stator 3 is composed, in the illustrated embodiment, of three sections spaced apart along the axis of the device, between glide rail 11 and stator 4. The first section 3*a* is composed of at least one wire, and possibly two or more wires. In section 3*b*, each wire of section 3*a* is connected in series with two or more wires. Similarly, in section 3*c*, each wire of section 3*b* is connected in series with two or more wires. The opposite end of each wire in section 3*c* is conductively connected to stator 4, which is formed from a solid sheet of metal. All of the wires in sections 3*a*, 3*b* and 3*c* may have the same diameter and all of the wires of stator 3, and stator 4, are made of suitable electrically conductive material. When the FCG is activated, the current generated in the stator assembly 3, 4 will increase progressively from the initiation end. The structure of stator 3, as described above, will make it possible for stators 3 and 4 to support the increasing current load.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An explosive device comprising;

a flux compression generator operative to produce a high intensity electric current wherein the flux compression generator has an axially symmetrical form with a longitudinal axis and includes an annular shell containing high explosives, an annular armature surrounding said annular shell, an annular stator assembly surrounding said armature and spaced from said armature by an electrical insulating medium, and an electrical circuit connected to produce a seed current that flows through said armature and said stator assembly in series and to detonate said high explosives after the seed current has been established in order to generate the high intensity electric current; and an electrical payload connected to said generator and constructed to receive the high intensity electric current and cause energy in the current to generate a shaped projectile in the payload and to launch the projectile.

2. The device according to claim 1, wherein said electrical payload comprises at least two components each constructed to generate and launch a respective shaped projectile.

3. The device according to claim 2, wherein said payload has a longitudinal axis and said at least two components are spaced apart along said longitudinal axis.

4. The device according to claim 3, wherein said at least two components comprise a first component connected directly to said generator, and a second component connected directly to said first component, and said electrical payload further comprises a switch member between said first and second components and operative to first direct the high intensity electric current to said first component to produce a first shaped projectile and to then direct the high intensity electric current to said second component to produce a second shaped projectile.

5. The device according to claim 1, wherein said annular stator assembly comprises a first stator member composed of a helical coil of electrically conductive material and a second stator member composed of a solid cylinder of electrically conductive material, said first and second stator members being electrically connected to one another in series and being spaced apart along said longitudinal axis.

6. The device according to claim 5, wherein said armature is a unitary body that is axially coextensive with said first and second stator members.

7. The device according to claim 5, wherein said flux compression generator further comprises a munition enclosed by said annular shell and including a detonator that is actuated by said electrical circuit.

8. The device according to claim 7, wherein said flux compression generator further comprises an annular buffer layer between said munition and said annular shell.

9. The device according to claim 5, wherein said first stator member comprises at least two sections space apart along the longitudinal axis of said flux compression generator, said first section comprising at least one wire extending from an ignition end of said device, and said second section being connected in series between said first section and said second stator member, said second section being composed of a plurality of wires each connected in series with said at least one wire, the number of wires in said second section being larger than the number of wires in said first section.

* * * * *